US007832532B2

(12) United States Patent
Nykoluk et al.

(10) Patent No.: US 7,832,532 B2
(45) Date of Patent: Nov. 16, 2010

(54) PIVOTAL HANDLE FOR TOWABLE BAGGAGE

(75) Inventors: Cory O. Nykoluk, St. Louis, MO (US); David Mittleman, Chesterfield, MO (US)

(73) Assignee: TRG Accessories, LLC, St. Louis, MO (US)

( * ) Notice: Subject to any disclaimer, the term of this patent is extended or adjusted under 35 U.S.C. 154(b) by 1023 days.

(21) Appl. No.: 10/688,447

(22) Filed: Oct. 17, 2003

(65) Prior Publication Data

US 2004/0084268 A1 May 6, 2004

Related U.S. Application Data

(63) Continuation of application No. 09/705,171, filed on Nov. 2, 2000, now Pat. No. 6,651,791.

(51) Int. Cl.
*A45C 13/26* (2006.01)

(52) U.S. Cl. ..... 190/115; 190/18 A; 16/113.1

(58) Field of Classification Search ..... 190/115, 190/18 A; 16/113.1
See application file for complete search history.

(56) References Cited

U.S. PATENT DOCUMENTS

| | | | | | |
|---|---|---|---|---|---|
| 853,566 | A | * | 5/1907 | Sparks | 294/57 |
| 1,616,632 | A | | 2/1927 | Mastrontonio | |
| 2,722,137 | A | | 11/1955 | Russell | |
| 2,822,143 | A | | 2/1958 | Johansen | |
| 3,401,951 | A | | 9/1968 | Bloom | |
| 3,496,795 | A | | 2/1970 | Dinnendahl | |
| 3,606,372 | A | | 9/1971 | Browning | |
| 3,799,568 | A | | 3/1974 | Hager | |
| 4,037,858 | A | | 7/1977 | Adams | |
| 4,273,222 | A | * | 6/1981 | Cassimally et al. | 190/18 A |
| 4,368,835 | A | | 1/1983 | Murphy | |
| 4,538,709 | A | | 9/1985 | Williams | |
| D282,787 | S | | 2/1986 | Nichols | |
| 4,616,379 | A | | 10/1986 | Lio | |
| 4,621,404 | A | | 11/1986 | Browing | |
| 4,759,431 | A | * | 7/1988 | King et al. | 190/18 A |
| 4,838,396 | A | | 6/1989 | Krenzel | |

(Continued)

FOREIGN PATENT DOCUMENTS

| | | | |
|---|---|---|---|
| GB | 2337986 | * | 8/1999 |

(Continued)

*Primary Examiner*—Tri M Mai
(74) *Attorney, Agent, or Firm*—Armstrong Teasdale LLP

(57) ABSTRACT

A towing member for a piece of towable baggage is provide with towing handle that is pivotal relative to an arm portion of the towing member. The pivotal relation of the towing handle and the arm potion enables the towing handle to be rotated into a position where a person can grasp the towing handle in a comfortable position by his or her side when the piece of baggage is being towed. The pivotal relation of the towing handle and the arm potion also improves the maneuverability of a towable piece of baggage by reducing the need for a person to twist his or her wrist when steering the piece of baggage. The invention also allows the towing handle of retractable towing members to be pivoted into an appropriate position relative to the piece of baggage such that the towing handle lies flush with the baggage and will not become snagged on other items.

23 Claims, 4 Drawing Sheets

U.S. PATENT DOCUMENTS 5,002,304 A 3/1991 Carrigan, Jr.
5,048,649 A 9/1991 Carpenter et al.
5,197,579 A 3/1993 Bieber et al.
5,207,440 A 5/1993 Liang
5,249,438 A 10/1993 Rhaney et al.
5,323,887 A 6/1994 Scicluna et al.
5,328,122 A 7/1994 Yamaguchi
5,330,037 A 7/1994 Wang
5,339,934 A 8/1994 Liang
5,353,900 A 10/1994 Stilley
5,385,220 A * 1/1995 Pond et al. ..... 190/18 A
5,429,317 A 7/1995 Yamaguchi
5,431,428 A 7/1995 Marchwiak et al.
5,464,080 A 11/1995 Liang
5,464,081 A 11/1995 Zwanzig
5,469,945 A 11/1995 Jserng
5,491,872 A 2/1996 Tserng
5,497,865 A 3/1996 Yun-Pi
5,547,053 A 8/1996 Liang
5,564,538 A 10/1996 Sadow
5,615,757 A 4/1997 Chen
5,630,521 A 5/1997 Waddell et al.
5,645,146 A * 7/1997 Bieber et al. ..... 190/18 A
5,647,095 A 7/1997 Takimoto
5,689,854 A 11/1997 Wang
5,690,196 A 11/1997 Wang
D387,198 S 12/1997 Lehmann et al.
5,706,921 A 1/1998 Wang
5,713,441 A 2/1998 Chen
5,722,118 A 3/1998 Hansen et al.
5,749,503 A 5/1998 Wulf et al.
5,752,415 A 5/1998 Tsai
D395,361 S 6/1998 Zionts et al.
5,769,194 A 6/1998 Chang
5,813,504 A 9/1998 Iny et al.
5,855,408 A 1/1999 Rickabus
5,865,281 A 2/1999 Wang
5,884,362 A 3/1999 Tsai
5,890,570 A 4/1999 Sadow
5,893,495 A 4/1999 Godshaw et al.
5,901,822 A 5/1999 Tu
5,908,093 A 6/1999 Miyoshi
5,934,425 A 8/1999 Sadow
5,943,936 A 8/1999 Deliman et al.
5,984,154 A 11/1999 Scicluna
5,996,177 A 12/1999 Cheng
6,009,598 A 1/2000 Chang
6,032,771 A 3/2000 Pedrini
6,041,900 A 3/2000 Sadow et al.
6,059,301 A 5/2000 Skarnulis
6,122,800 A * 9/2000 Cheng ..... 16/113.1
6,179,101 B1 1/2001 Lin
6,179,176 B1 1/2001 Saggese et al.
6,193,033 B1 2/2001 Bogert
6,237,734 B1 5/2001 Chen
6,279,706 B1 8/2001 Mao
6,298,964 B1 10/2001 Sadow
6,301,746 B1 10/2001 Myers et al.
6,317,924 B1 11/2001 Gallagher
6,332,242 B1 12/2001 Chen
6,431,563 B1 * 8/2002 Kang ..... 280/47.18
6,434,790 B1 8/2002 Chen
D463,124 S 9/2002 Godshaw et al.
6,464,245 B1 10/2002 Miles
6,508,344 B1 1/2003 Lu
6,530,459 B1 3/2003 Lu
6,564,426 B1 5/2003 Wang
6,575,274 B1 6/2003 Huang
6,591,951 B1 7/2003 Chen
6,651,791 B1 * 11/2003 Nykoluk et al. ..... 190/18 A
2002/0050429 A1 5/2002 Nykoluk et al.
2003/0000785 A1 1/2003 Miller et al.
2003/0079950 A1 5/2003 Lin et al.
2003/0085089 A1 5/2003 Lin et al.
2003/0102195 A1 6/2003 Mittleman et al.
2003/0132079 A1 7/2003 Bellini
2003/0132080 A1 7/2003 Dababneh

FOREIGN PATENT DOCUMENTS

TW 090221299 12/2001
WO WO 98/07344 2/1998
WO WO 01/52687 7/2001
WO WO 03/053186 7/2003

* cited by examiner

PIVOTAL HANDLE FOR TOWABLE BAGGAGE

CROSS REFERENCE TO RELATED APPLICATIONS

This application is a Continuation of and claims priority to U.S. patent application Ser. No. 09/705,171 filed Nov. 2, 2000, now issued U.S. Pat. No. 6,651,791, the entire disclosure of which is herein incorporated by reference.

BACKGROUND OF THE INVENTION (1) Field of the Invention

This invention pertains to the field of hand towable travel baggage. More particularly, this invention pertains to a towing member having a towing handle that is pivotally attached to an arm portion of the towing member. The pivotal connection between the towing handle and the arm portion of the towing member allows a person to hold the towing handle in a position that is more comfortable than would otherwise be possible when towing a piece of baggage along a surface. Furthermore, the pivotal connection increases the maneuverability of hand towable baggage by allowing a person to steer a piece of baggage along a tight radius without having to adjust his or her grip on the towing handle.

(2) Description of the Related Art

It is common for many varieties of baggage to be equipped with one or more wheels that enable the baggage to be towed by persons when traveling. Typically, a towable piece of baggage is also provided with a towing member having an arm portion that connects a towing handle to the piece of baggage. The length of the arm portion connecting the towing handle to the piece of baggage prevents the baggage from coming into contact with the person's legs and feet as the piece of baggage is being towed.

Baggage that are not permanently equipped with either wheels or towing members can also be towed using portable towing carts. A typical cart can be removably secured to a piece of baggage to provide wheels and a towing member for towing the piece of baggage.

Regardless of whether a towing member is an integral part of a piece of baggage or whether it is part of a towing cart, the majority of towing members allow a towing handle to be selectively extended from and retracted toward a piece of baggage being towed. The ability to extend and retract the towing member allows the towing member to be unobtrusive when the piece of baggage is not being towed. Furthermore, with the towing member in the retracted position, the piece of baggage can more easily be placed into the trunk of an automobile or into an overhead compartment of an airplane when traveling.

In those cases where the wheels and the towing member of towable baggage are permanently secured to the baggage, it is common for a wheeled piece of baggage to have an extendable towing member comprised of a pair of parallel telescoping poles, bridged by a towing handle, that slide into separate vertically oriented tubular receptacles rigidly attached to an interior compartment of the piece of the baggage. It is also known to utilize a single-pole telescoping tow member that extends and retracts from a single tubular receptacle centrally positioned between the wheels of a piece of baggage. In either situation, a piece of baggage having a permanently secured towing member typically has a receptacle for the towing handle such that the towing handle lies flush with an exterior surface of the piece of baggage when the towing member is retracted. This prevents the towing handle from being obtrusive and reduces the chance of snagging the towing handle on other items, while also improving the aesthetic appearance of the piece of baggage when the piece of baggage is not being towed.

Perhaps more common of towing carts, other types of baggage utilize non-telescoping extendable towing members such as bars or poles that are hinged to swing relative to the piece of baggage. Typically, such hinged towing members have some form of clasp that holds the towing member against a side of the piece of baggage when the baggage is not being towed and that releases the towing member when desired to allow the towing member to pivot upwardly into an extended position.

Regardless of the type of towing member, extendable towing members are usually provided with a mechanism for locking the towing member in the extended position. Such locking mechanisms are well known in the art and include such devices as spring-loaded detents, cam locks, and other interference locks. Some locking mechanisms are unlocked by manually operating a release mechanism. Other locking mechanisms, such as many spring-loaded detent mechanisms, are automatically released by simply exerting a force on the towing handle that is sufficient to retract the detent. Additionally, some towing members have locking mechanisms that are capable of locking the towing member in the retracted position.

Despite the convenience of being able to tow a piece of baggage as opposed to carrying it when traveling, towing a piece of baggage can be awkward and uncomfortable. One reason that towing a piece of baggage can be uncomfortable lies in the positioning and the shape of the towing handle of most towing members. As mentioned above, it is common for the towing handle of dual-pole towing members to be a bridge spanning between the poles. Such towing handles are therefore generally oriented horizontal to the surface upon which the piece of baggage is being towed and extend perpendicular to the path along which the piece of baggage is being towed. In this configuration, a person must generally grasp the towing handle behind his of her back with his or her wrist rotated to almost its limit of rotation in either direction. When towing such baggage long distances, this position can become uncomfortable and such persons often find it necessary to switch hands one or more times to prevent fatigue.

Regardless of the disadvantages in comfort associated with the towing handle configuration as described above, alternative orientations of the towing handles are often not available without comprising other aspects of the utility of such devices. For example, shaping the handle of an extendable towing member in a manner that would be more comfortable is likely to cause the handle to protrude from the piece of baggage or require a larger receptacle for the handle when the towing member is retracted. Another disadvantage associated with the towing handle configuration described above is that, due to the awkward grasp needed to hold onto the towing handle, the maneuverability of a towed piece of baggage becomes limited by the person's inability to further twist his or her wrist.

SUMMARY OF THE INVENTION

The towing member of the present invention is designed to be either permanently or removably attached to a piece of baggage. In accordance with the present invention, a towing member is provided with a pivot mechanism that allows a towing handle of the towing member to pivot about an axis relative to an arm portion of the towing member.

The relative movement between the towing handle and the arm portion of the towing member allows a person to grasp the towing handle in a comfortable position when towing a piece of baggage. Additionally, the relative movement between the towing handle and the arm portion of the towing member increases the maneuverability of a towed piece of baggage by eliminating the need for a person to adjust his or her grip on the towing handle when attempting to redirect the piece of baggage. Furthermore, the relative movement between the towing handle and the arm portion allows the towing handle to be repositioned when the arm portion is retracted such that it is unobtrusive and does not otherwise interfere with the use of the piece of baggage.

In general, the towing member of the present invention comprises an arm portion, a towing handle, and a pivot mechanism. The arm portion is configured to connect the towing handle to a piece of baggage while the pivot mechanism allows the towing handle to be connected to the arm portion in a manner such that the towing handle can pivot relative to the arm portion.

In the preferred embodiment of the invention, the arm portion utilizes a curved, single-pole telescoping member that enables the towing handle to be selectively extended from and retracted toward a piece of baggage. The towing handle of the preferred embodiment is T-shaped and the pivoting mechanism allows the handle to pivot about a center-axis of the arm portion that is defined by the length of the arm portion.

By enabling the towing handle to pivot about the center-axis of arm portion, the towing handle of the preferred embodiment can be pivoted such that its crossbar or hand grip portion extends up and back relative to a person using the towing member to tow a piece of baggage. Thus, unlike towing members having handles oriented horizontally and sided-to-side, the towing handle of the preferred embodiment can be grasped by a person with their hand by their side and with their wrist facing their waist. Thus, the towing handle of the preferred embodiment can be grasped in a natural and comfortable manner similar to now one carries a briefcase. The slope up and back of the hand grip provides additional comfort by allowing a person to position his or her wrist in the middle of its range of motion. Additionally, the pivotal relative motion between the towing handle and the arm portion reduces the need for a person to twist his or her wrist when maneuvering the piece of baggage.

The towing member of the preferred embodiment is adapted to be permanently secured to a piece of baggage and the towing member preferably comprises a receptacle for recessing the towing handle therein when it is desirable to retract the towing handle. When so doing, the towing handle can be pivoted such that the hand grip is oriented horizontally and side-to-side, which is generally preferable for recessing towing handles due to preferred placement of towing members immediately adjacent an exterior surface of the baggage.

While the principle advantages and features of the present invention have been described above, a more complete and thorough understanding and appreciation for the invention may be attained by referring to the drawings and the detailed description of the preferred embodiment, which follow.

BRIEF DESCRIPTION OFF THE DRAWINGS

Reference characters in the written specification indicate corresponding parts throughout the several views of the drawings.

DETAILED DESCRIPTION OF THE PREFERRED EMBODIMENT

Figure 1:
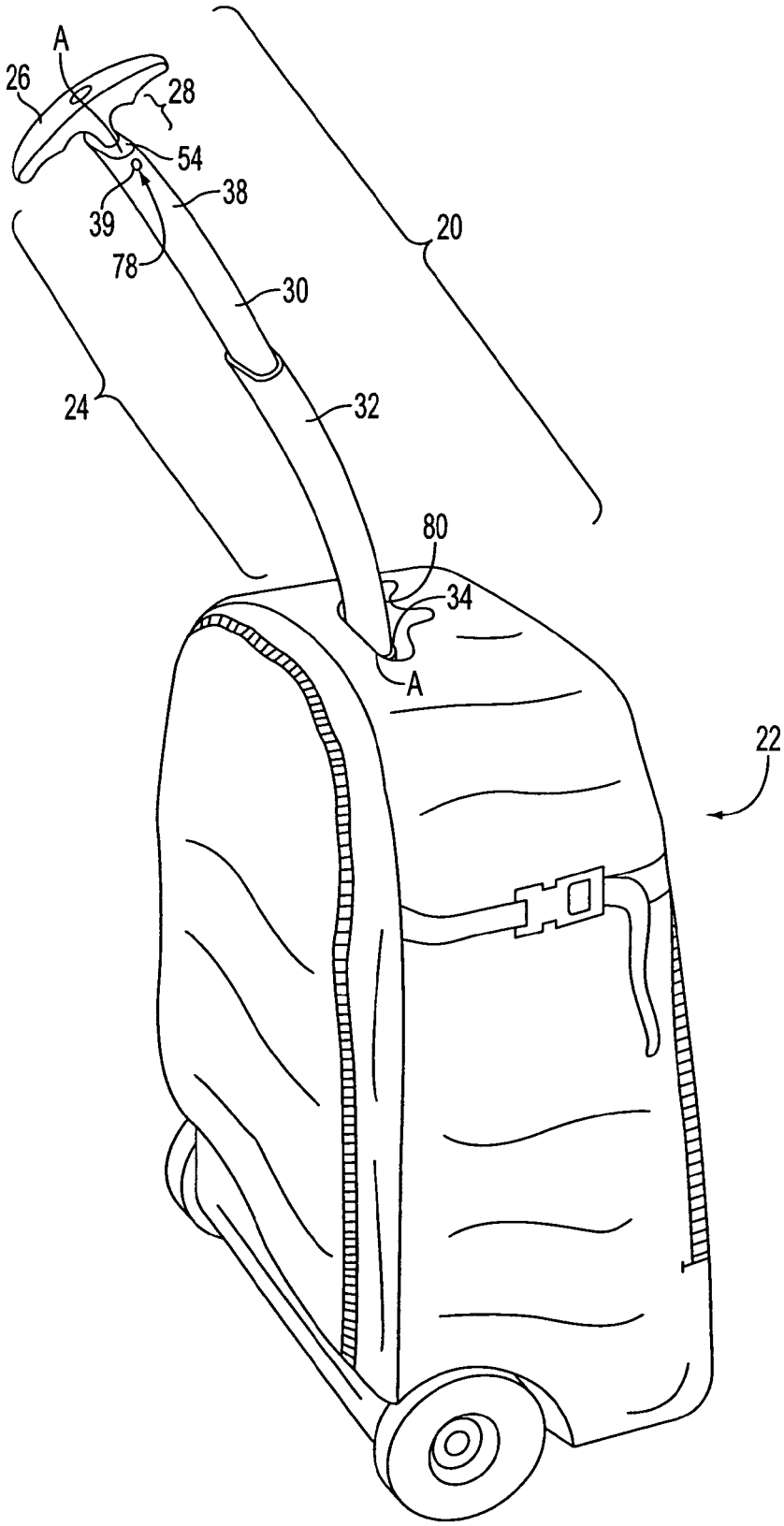
FIG. 1 is an isometric view of the towing member of the preferred embodiment secured to a wheeled backpack with the arm portion in an extended position and with the towing handle rotated relative to the arm portion such that the hand grip of the towing handle lies in a generally vertical plane that includes the center-axis of the arm portion.
Figure 2:
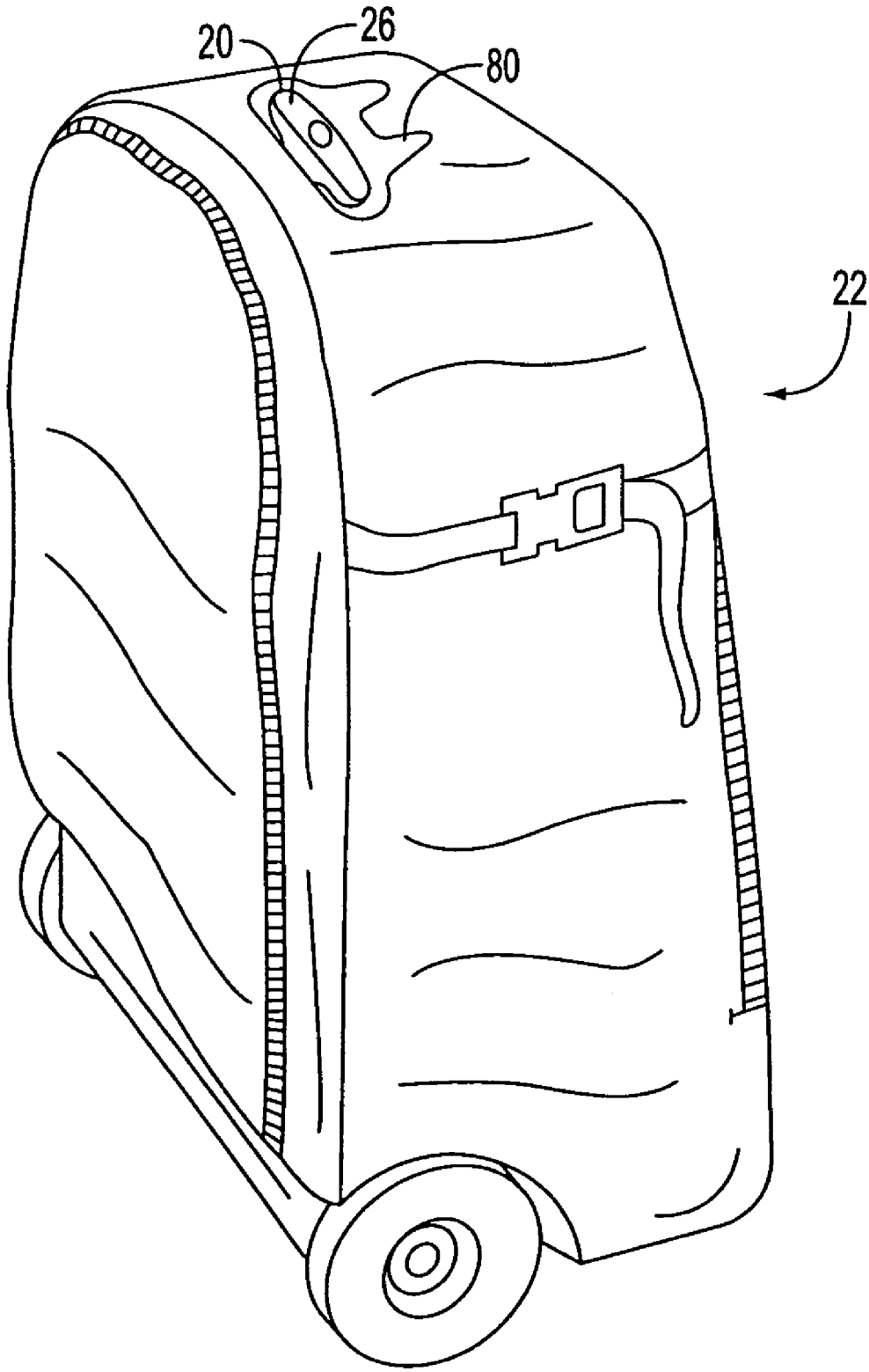
FIG. 2 is an isometric view of the towing member of the preferred embodiment secured to a wheeled backpack with the arm portion in a retracted position and with the towing handle rotated relative to the arm portion such that the hand grip of the towing handle is horizontally oriented.
Figure 3:
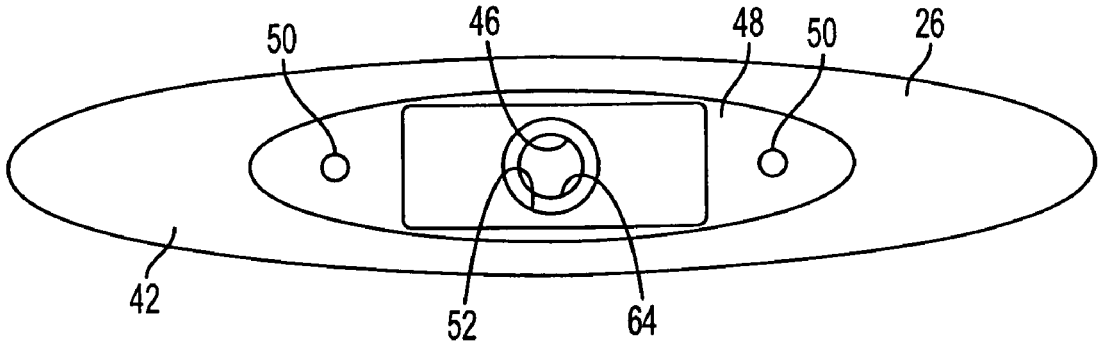
FIG. 3 is an top view of the towing handle of the towing member of the preferred embodiment.
Figure 4:
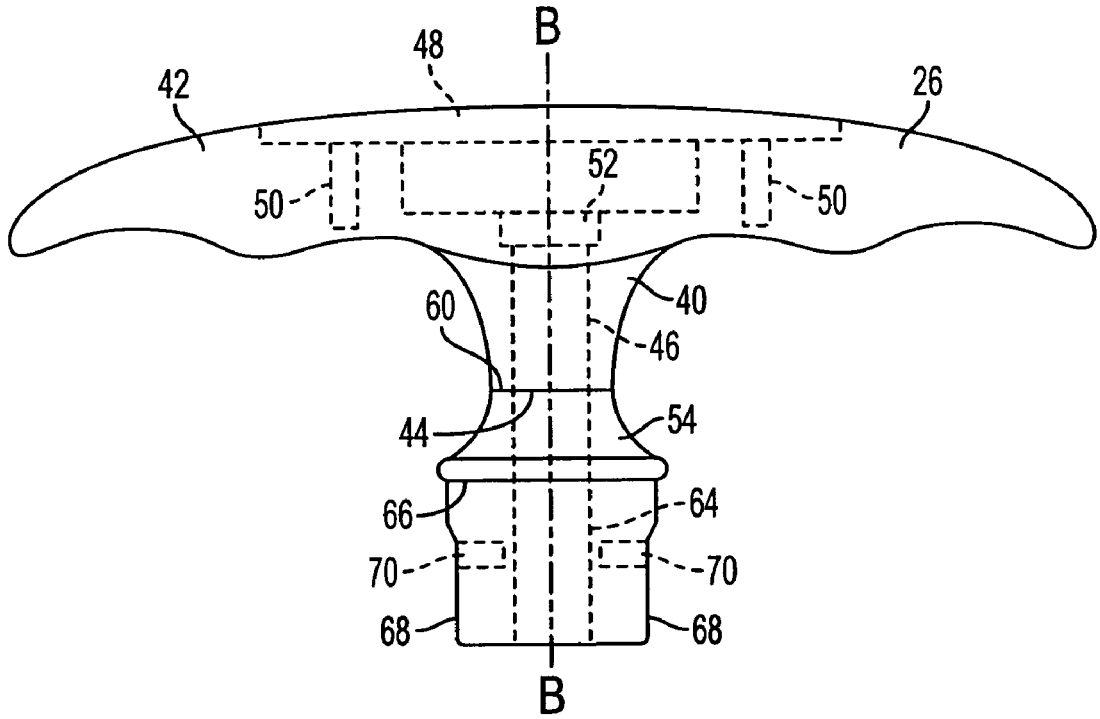
FIG. 4 is an elevation view of the towing handle and pivot mechanism of the towing member of the preferred embodiment.
Figure 5:
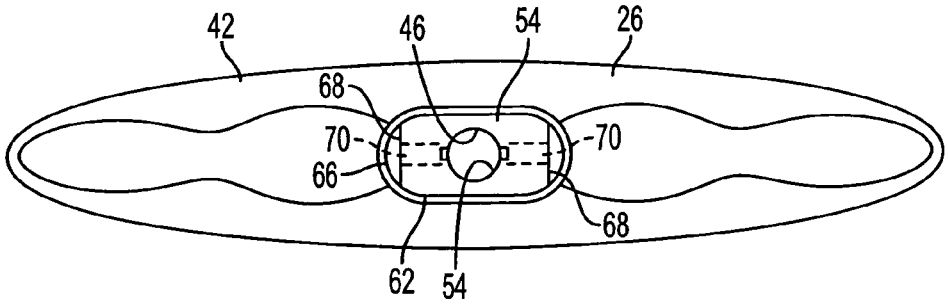
FIG. 5 is a bottom view of the towing handle and pivot mechanism of the towing member of the preferred embodiment.

The preferred embodiment of the towing member of the invention is specifically adapted and configured to be an integral part of a piece of baggage. As shown in FIGS. 1 and 2, the towing member 20 of the preferred embodiment is attached to a wheeled backpack 22 and is comprised of an arm portion 24, a towing handle 26, and a pivot mechanism 28. Although shown attached to a wheeled backpack, the towing member is not limited to this use and can be used with other types of wheeled baggage as well as with wheeled carts for baggage.

As shown in FIG. 1, the arm portion 24 of the preferred embodiment is a curved, retractable single-pole telescoping member formed by a plurality of slidably engaged tubular sections 30, 32, 34. The tubular sections 30, 32, 34 each have an elliptical or oval cross-section and are configured to slide one inside the other in a telescoping manner. To reduce wear and provide sufficient strength, the tubular sections 30, 32, 34 are preferably made of steel, aluminum, or other suitable materials. The tubular section 34 having the largest cross-section is fixed to inside of the backpack 22 and the remaining tubular sections 30, 32 telescope therefrom along an arcuate path that defines a center-axis A-A along the length of the arm portion 24. A locking mechanism (not shown) is preferably configured to automatically lock the arm portion 24 in the extended position once the arm portion is fully extended. Such locking mechanisms are well known in the art and the specific type of locking mechanism is not relevant to the operation of the towing member. Opposite the tubular section 34 that is fixed to the backpack 22, the distal tubular section 30 having the smallest cross-section has an end 38 that remains free to support the towing handle 26. A pair of holes 39 are provide adjacent the free end 38 to secure the towing handle 26 to the arm portion 24 as described below.

The towing handle 26 is preferably T-shaped and is preferably formed of a polymeric material. The T-shape of the towing handle 26 is formed by a stem 40 that preferably extends perpendicularly from a crossbar or hand grip 42 along a center axis B-B of the stem. The stem 40 of the towing handle 26 terminates at a flat, circular bearing surface 44 that is perpendicular to the center axis. A cylindrical through-hole 46 extends along the center axis through the stem 40 and hand grip 42. A counter-bore 52 is preferably formed into the towing handle 26 at the top of the through-hole 46. The bearing surface 44, the through-hole 46, and the counter-bore 52 of the towing handle 26 form portions of the pivot mechanism 28 as described below. Finally, a recessed cavity 48 and a pair of blind holes 50 are preferably formed in the top of the towing handle 26 to receive a release mechanism (not shown) for unlocking a locking mechanism used with the arm portion 24. Although the preferred embodiment of the towing handle is T-shaped, other shapes could be used. For example, the stem could extend from one end of the hand grip and curve such that the bearing surface 44 is centered relative to the hand grip or two stems could extend from the opposite ends of the hand grip and curve to join at a bearing surface.

In addition to the bearing surface 44, the through-hole 46, and the counter-bore 52 of the towing handle 26, the pivot mechanism 28 preferably comprises a connector 54, a journal-pin or pivot pin 56, and a nut 58. Like the towing handle 26, the connector 54 is preferably formed of a polymeric material and preferably has an upper, flat circular bearing surface 60 at one end and a base 62 at its opposite end. The bearing surface 60 of the connector 54 is preferably equal in area to the area of the bearing surface 44 of the towing handle 26. The connector 54 also has a center-bore 64 having a diameter equal to the diameter of the through-hole 46 of the towing handle 26 that extends through the connector 54 perpendicularly from the bearing surface 60. The base 62 of the connector 54 has a cross-section similar to the cross-section of the free end 38 of the smallest tubular section 30 and terminates at an annular rim 66. A pair of parallel flats 68 are formed on opposite sides of the base 62 parallel to the center-bore 64 and a pair of coaxial blind-holes 70 extend perpendicularly into the flats 68.

The journal-pin 56 of the pivot mechanism 28 is preferably formed of steel or aluminum and has an outer cylindrical diameter substantially equal to the diameter of the through-hole 46 of the towing handle 26 and the center bore 64 of the connector 54. The journal-pin 56 preferably has a head 72 at one of its opposite axial ends and a threaded portion 74 at the other of Its opposite axial ends. The threaded portion 74 is configured for receiving the nut 58 of the pivot mechanism 28. The journal-pin 56 also preferably has an axial though-hole or center bore 76.

Figure 6:
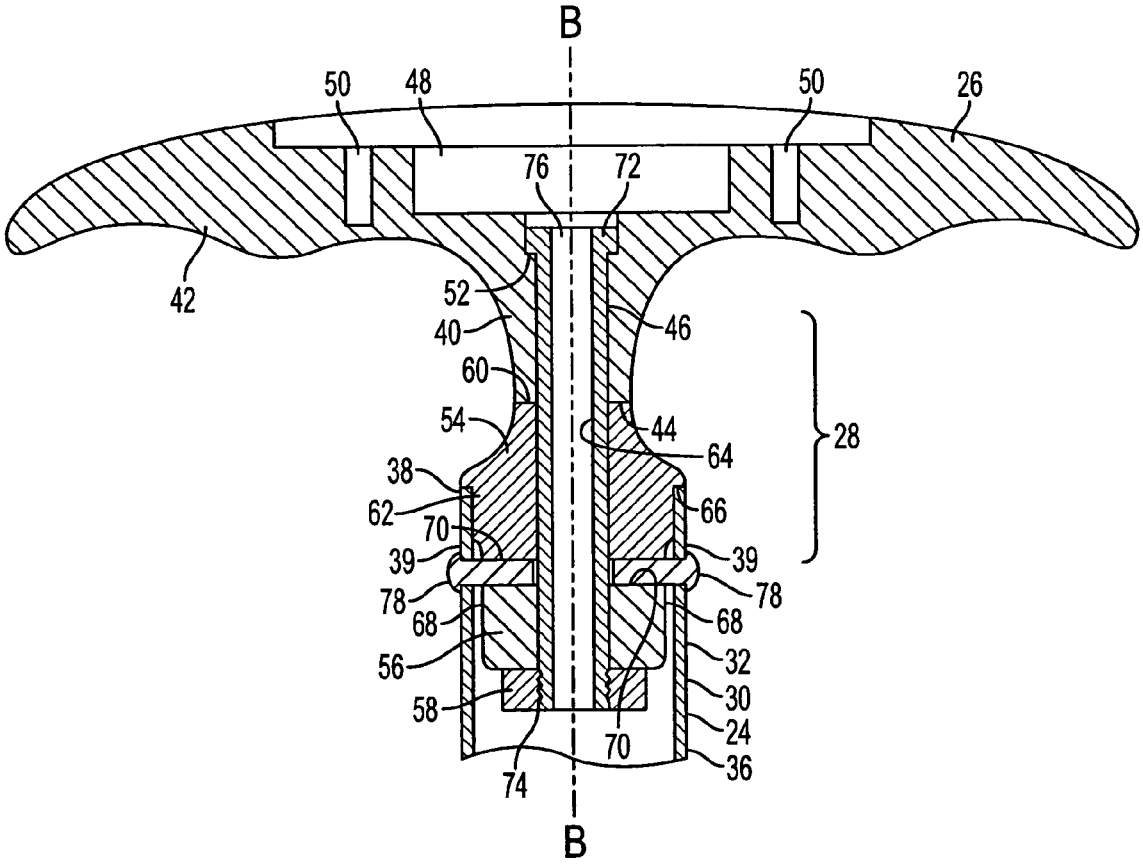
FIG. 6 is a cross-sectional, partial view of the towing member of the preferred embodiment showing the assembly of the towing handle to the arm portion.

As shown in FIG. 6, the towing member 20 of the preferred embodiment is assembled by passing the journal-pin 56 through the through-hole 46 of the towing handle 26 and the center-bore 64 of the connector 54 with the head 72 of the journal-pin recessed in the counter-bore 52 of the towing handle 26 and the nut 58 threaded on the threaded portion 74 of the pin. Thus, the journal-pin 56 attaches the towing handle 26 to the connector 54 in a manner such that the bearing surface 44 of the towing handle 26 is in a flush, rotational sliding engagement with the bearing surface 60 of the connector 54. The base 62 of the connector 54 is inserted into the free end 38 of the smallest telescoping section 30 until the rim 66 of the connector is engaged with the free end. The connector 54 is preferably secured to the free end 38 of the telescoping section 30 by a pair of screws or rivets 78 passing through the holes 39 of the free end 38 into the blind-holes 70 of the connector 54. However, other means of connection could be used. The connector secured to the free end 38 of the telescoping section 30 defines the distal end of the arm portion 24.

Configured as describe above, the journal-pin 56 is aligned with the center-axis A-A of the arm portion 24 and the towing handle 26 is free to pivot thereabout. The configuration of the telescoping tubular sections 30, 32, 34 allows the arm portion 24 to be movable between an extended position and a retracted position. In the extended position as shown in FIG. 1, the towing handle 26 is positioned away from the backpack 22, thereby allowing a person to tow the backpack without the backpack coming into contact with the person's feet. In the retracted position, the tubular sections 30, 32, 34 of the arm portion 24 are retracted into each other and the towing handle 26 is thereby retracted into a receptacle 80 provided in the top of backpack 22, as shown in FIG. 2. The shape of the towing handle 26 allows a person to grip the hand grip 42 in his or her palm with the stem 40 extending between the person's index finger and his or her middle finger when towing the backpack 22. Furthermore, the towing handle 26 can be pivoted such that the hand grip 42 of the towing handle extends up and back, thereby allowing a person to grasp the towing handle without twisting his or her wrist. Furthermore, when stowing or wearing the backpack 22, the towing handle 26 can be pivoted and retracted into the receptacle 80 of the backpack where it lies flush and is unlikely to become snagged or hooked on other items. The recess 48 and blind-holes 50 in the towing handle 26 and the center bore 76 of the pivot pin 56 allow a release mechanism to be positioned on the towing handle and extending through the pivot pin center bore 76 for releasing a locking mechanism (not shown) that allows the arm portion 24 to be retracted into the backpack 22. The pivotal connection between the towing handle 56 and the arm portion 24 also allows a person to steer the backpack 22 without twisting his or her wrist, thereby reducing fatigue and improving the overall maneuverability of the piece of baggage when being towed.

While the invention has been described in reference to a specific embodiment, it should be understood that modifications and variations could be made without departing from the scope of the invention. For example, it should be understood that the use of the towing member of the invention is not limited to backpacks and the towing member could be used on various other types of baggage. Additionally, the arm portion of the towing member need not necessarily be a curved single-pole telescoping member. Hence it should be clear that numerous variations of the invention could be made without departing from the scope of the invention defined by the following claims.

What is claimed:

1. A hand towed piece of baggage comprising:

a piece of baggage having a top and a bottom;

a set of wheels rotationally mounted towards said bottom of said piece of baggage;

a receptacle providing an opening in said top of said piece of baggage;

an arm portion retractably engaged to said piece of baggage and having an adjustable axial length extending between opposite proximal and distal ends, said proximal end being operatively secured to said piece of baggage and said distal end positionable between an extended position and a retracted position through said receptacle, wherein in said retracted position said distal end is closer to said piece of baggage than in said extended position;

a connector fixedly mounted to said distal end; and a towing handle having a hand grip, the towing handle being separately provided from the connector and engaged to the connector such that said hand grip can pivot relative to said connector about a pivot axis that intersects the hand grip when said arm portion is in said extended position, and such that said towing handle grip is retracted at least partially into said receptacle when said arm portion is in said retracted position.

2. The piece of baggage of claim 1, wherein:
said arm portion has a center axis along the axial length, the center axis defining an arcuate telescoping path for moving the distal end between the extended and retracted positions.

3. The piece of baggage of claim 1, wherein:
said arm portion has a non-circular cross-section perpendicular to the axial length.

4. The piece of baggage of claim 3, wherein:
said arm portion is arcuate along the axial length.

5. The piece of baggage of claim 1, wherein:
said arm portion is a single-pole arm portion.

6. The piece of baggage of claim 5, wherein:
said single-pole arm portion is arcuate between the proximal and distal ends along a center axis corresponding to said axial length.

7. The piece of baggage of claim 1, wherein:
the pivot axis bisects the hand grip of the towing handle.

8. The piece of baggage of claim 7 wherein:
said towing handle further comprises a stem connected to said handgrip.

9. The piece of baggage of claim 8, wherein:
said stem intersects said handgrip at a generally perpendicular relation.

10. The piece of baggage of claim 8, wherein:
said stem extends from one end of said handgrip and curves to said distal end of said arm portion.

11. The piece of baggage of claim 8, wherein:
said stem comprises a single stem.

12. The piece of baggage of claim 1 wherein:
said towing handle further comprises a stem connected to said handgrip.

13. The piece of baggage of claim 12, wherein:
said stem intersects said handgrip at a generally perpendicular relation.

14. The piece of baggage of claim 12, wherein:
said stem extends from one end of said handgrip and curves to said distal end of said arm portion.

15. The piece of baggage of claim 12, wherein:
said stem comprises a single stem.

16. The piece of baggage of claim 1, wherein:
in said retracted position, said towing handle lies flush with said piece of baggage.

17. A hand towed piece of baggage comprising:
a piece of baggage;
a set of wheels rotationally mounted on the piece of baggage;
a retractable arm portion, the arm portion comprising a plurality of tubular sections that are telescopically engaged with each other and having an axial length extending between opposite proximal and distal ends, the proximal end being operatively secured to the piece of baggage and the distal end being selectively movable between a retracted position and an extended position relative to the proximal end via the tubular sections telescoping in a manner such that the distal end is closer to the piece of baggage when in the retracted position than when the distal end is in the extended position, the arm portion further having a non-circular cross section perpendicular to the axial length so that the tubular sections cannot slidably twist relative to each other when the distal end of the arm portion is in the extended position;
a connector mounted stationary to the distal end;
a towing handle having a hand grip, the towing handle being separately provided from the connector and abutting the connector in a manner such that the hand grip can pivot relative to the connector about a pivot axis that intersects the hand grip when the distal end of the arm portion is in the extended position;
wherein the towing handle is generally unobtrusive when in the retracted position.

18. The piece of baggage of claim 17, wherein:
the tubular sections of the arm portion are arcuate along their axial lengths.

19. The piece of baggage of claim 17, wherein:
the arm portion is a single-pole arm portion.

20. A hand towed piece of baggage comprising:
a piece of baggage;
a set of wheels rotationally mounted on the piece of baggage;
a retractable arm portion, the arm portion comprising a plurality of curved tubular sections that are telescopically engaged with each other and having an arched axial length extending between opposite proximal and distal ends, the proximal end being operatively secured to the piece of baggage and the distal end being selectively movable between a retracted position and an extended position relative to the proximal end via the tubular sections telescoping in a manner such that the distal end is closer to the piece of baggage when in the retracted position than when the distal end is in the extended position;
a connector mounted stationary to the distal end;
a towing handle having a hand grip, the towing handle being separately provided from the connector and abutting the connector in a manner such that the hand grip can pivot relative to the connector about a pivot axis that intersects the hand grip when the distal end of the arm portion is in the extended position.

21. The piece of baggage of claim 20, wherein the arm portion further has a non-circular cross section perpendicular to the axial length so that the tubular sections cannot slidably twist relative to each other when the distal end of the arm portion is in the extended position.

22. The piece of baggage of claim 20, the towing handle comprising a stem that is integrally formed with the handle grip, the stem defining a bearing surface for abutment with the connector.

23. The piece of baggage of claim 20, wherein the telescoping of the tubular sections follows an arcuate path extending away from a center axis of the piece of baggage.

* * * * *